US005791315A

United States Patent [19]

Riach et al.

[11] Patent Number: 5,791,315

[45] Date of Patent: Aug. 11, 1998

[54] CONTROL SYSTEM FOR SCREW TYPE SUPERCHARGING APPARATUS

[75] Inventors: Alan Bryson Riach, East Kilbride; John McGruer, Glasgow, both of United Kingdom

[73] Assignee: Sprintex Australasia Pty Ltd., Welshpool, Australia

[21] Appl. No.: 495,483

[22] PCT Filed: Jan. 31, 1994

[86] PCT No.: PCT/GB94/00184

§ 371 Date: Oct. 13, 1995

§ 102(e) Date: Oct. 13, 1995

[87] PCT Pub. No.: WO94/18456

PCT Pub. Date: Aug. 18, 1994

[30] Foreign Application Priority Data

Feb. 1, 1993 [GB] United Kingdom ..... 9301940
Nov. 13, 1993 [GB] United Kingdom ..... 9323463

[51] Int. Cl.[6] ..... F02B 33/36

[52] U.S. Cl. ..... 123/564; 418/201.2

[58] Field of Search ..... 123/564; 418/201.2

[56] References Cited

U.S. PATENT DOCUMENTS 2,519,913 8/1950 Lysholm ..... 418/201.2

FOREIGN PATENT DOCUMENTS 0412369 2/1991 European Pat. Off. .
484885 5/1992 European Pat. Off. .
1258652 3/1961 France .
641304 8/1950 United Kingdom .
2233042 1/1991 United Kingdom .
2233041 7/1991 United Kingdom .

*Primary Examiner*—Michael Koczo
*Attorney, Agent, or Firm*—Ratner & Prestia

[57] ABSTRACT

A three-mode control system for controlling the flow of inlet air into a supercharged spark ignition engine comprising an air expansion and compression apparatus, an inlet manifold, and an inlet port control valve for controlling the intake of air into the expansion and compression apparatus. The inlet port control includes an inlet port valve which is open at full engine load and progressively closes when the engine load is progressively reduced while the inlet manifold pressure remains above a predetermined level. An air flow throttle valve located upstream of the expansion and compression apparatus is open at full engine load and progressively closes when the engine load is progressively reduced and the inlet manifold pressure falls below the predetermined level. A bypass duct which can optionally bypass air around the expansion and compression apparatus is closed at full engine load and progressively opens when the engine load is reduced and the inlet manifold pressure falls below the predetermined level. The air supply to the engine may be throttled by the throttle valve before it passes to the engine via the expansion and compression apparatus or it may pass through the bypass duct.

3 Claims, 8 Drawing Sheets

CONTROL SYSTEM FOR SCREW TYPE SUPERCHARGING APPARATUS

Figure 1:
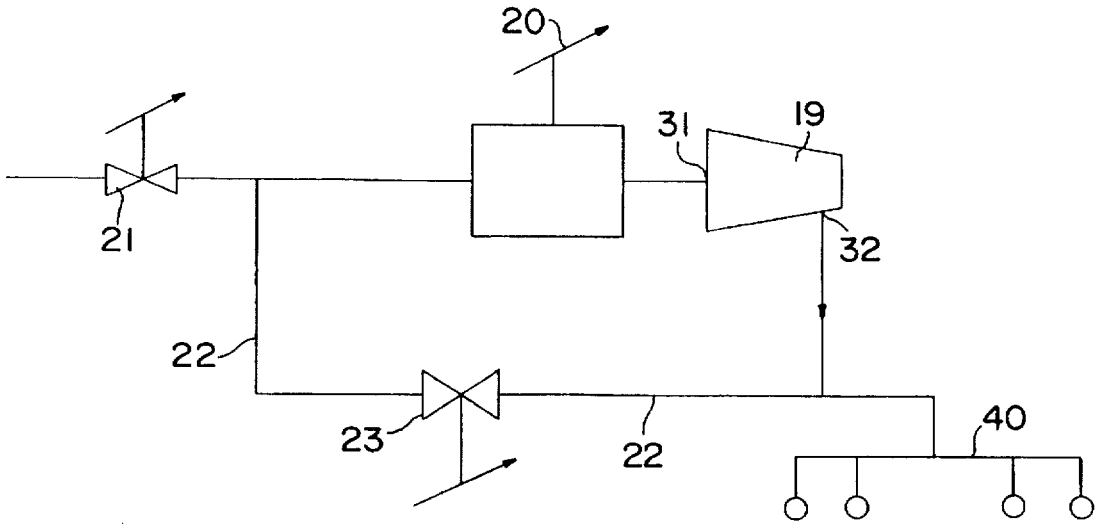

This invention is in the field of superchargers, as commonly used in the automotive industry. It has a particular relevance to supercharging spark ignition engines using a screw type positive displacement compressor. The invention also finds application in screw expander and compressor machines in general.

Screw rotor positive-displacement machines for an elastic working fluid are well known both as compressors and expanders. In such machines there is a casing comprising two intersecting bores, each bore containing one of a pair of inter meshing rotors. The rotors differ in that one rotor is of a male form having convex lands, while the other rotor is of a female type having concave lands, both rotors incorporating intervening grooves.

It has been found that partial rotation of the rotors causes the voids formed by the surfaces of the grooves of the rotors and the casing to expand. This action sucks gas into the voids through an inlet port. However, further rotation of the rotors causes the voids formed by the surfaces of the rotor grooves and the inner surfaces of the casing bores to interconnect and to decrease in volume causing a compression of the gas contained therein. Thus, it can be seen that within a screw rotor positive displacement machine of this type it is possible to both expand and compress a working fluid. This is particularly achieved where the inlet port of the machine is closed prior to the voids formed by the grooves of the rotors and the inner surfaces of the casing having reached their maximum volume, such that, as the rotors continue to rotate and the voids consequently increase in volume, an expansion is effected of the working fluid trapped therein. Further rotation of the said rotors causes the voids to decrease in volume and the working fluid is compressed. The outlet part is positioned to open and allow the gas to discharge when the desired compression has been achieved.

Accordingly, with judicious choice of the inlet port closing position and outlet port opening position a screw rotor positive displacement machine of this type has the ability to act simultaneously as an expander and a compressor.

One application where this is of potential benefit is in the supercharging of engines. In spark ignition engines the amount of fuel and air drawn into the engine per induction stroke is required to be varied and regulated according to the power output required of the engine. This part load regulation has in the past been achieved by throttling the flow of air into the engine. Nevertheless, this is undesirable as throttling is a non-reversible process and as such is associated with power loss at the engine pistons during the induction stroke.

Effectively, at part load engine power requirements the supercharger is still working even though the supercharging effect is not required. The pressure at the supercharger discharge (the engine inlet-manifold pressure) is greater than the pressure at the supercharger inlet. This results in lower overall engine efficiency than could be achieved with a naturally aspirated engine because the engine has to provide the power to drive the supercharger. This problem is common to all types of mechanically driven positive displacement superchargers.

Accordingly, it is a primary object of the present invention to provide a supercharging system wherein this problem is obviated or mitigated.

More specifically, an object of the present invention is to increase the efficiency for part load engine operation by using the expansion ability of a screw supercharger to reduce the charge air density. This gives rise to some of the engine piston work associated with the induction stroke being recovered.

In order to achieve the above objective it is required to provide a suitable means for controlling the size of or flow through the inlet and outlet ports.

Inlet arrangements are disclosed in GB2233041 and GB2233042 permitting control area variation of the gas inlet port, such arrangements facilitating the machine operating selectively in a compressing mode or in an expanding mode.

However, such inlet port controls have not been entirely satisfactory and the present invention discloses an alternative and potentially improved inlet port control for a screw expander/compressor machine.

It is also realised in the present invention that hitherto it has not been considered beneficial to use a bypass system in conjunction with positive displacement reducing volume superchargers. This was largely because of the understanding that bypass apparatus was only applicable when the supercharger positive displacement machines could be operated at a minimal or no load status when the engine itself was operating under a small load or indeed idling, for example, where a clutch was used to disconnect a mechanical drive to the supercharger. Thus, it was believed that when a positive displacement reducing volume supercharger is used, bypassing the working fluid would not reduce the power absorbed by the compressor on the basis that the compression process is inherent in the machine.

Nevertheless, in the present invention this belief has been found not entirely true as the invention provides a means for reducing the absorbed power of a positive displacement reducing volume screw compressor while using a bypass duct for part load or idle engine operation.

According to a first aspect of the present invention there is provided a three-mode control system for controlling the flow of inlet air into a supercharged spark ignition engine comprising air expansion and compression means, an inlet port control means for controlling the intake of air into the expansion and compression means, an air flow throttle valve located upstream of said expansion and compression means and a bypass duct which can optionally bypass air around the expansion and compression means, wherein the air supply to said engine may be throttled by said throttle valve before passing to the engine via said expansion and compression means or said bypass duct.

Preferably, the air expansion and compression means is a screw type positive displacement machine.

Preferably, the bypass duct includes a bypass valve for controlling optional flow of air through said bypass duct.

According to a second aspect of the present invention there is provided a three-mode control system for controlling the flow of inlet air into a supercharged spark ignition engine comprising air expansion and compression means, an inlet port control means for controlling the intake of air into the expansion and compression means, an air flow throttle valve located upstream of said expansion and compression means and a bypass duct having a bypass valve, wherein said three mode control system is controlled by the operation of said throttle valve, said inlet port control means and said bypass valve.

Preferably, the inlet port control means comprises one or more flap valves which divide the inlet port into sections in such a way that as the flap valves are closed they close off the voids formed by the intermeshing rotors and the casing at progressively earlier stages in the gas induction cycle.

According to a third aspect of the invention there is provided a method of controlling the three-mode control system according to any one of the preceding claims, the method providing different operating conditions dependent on engine load, such that:

1) at full engine load said throttle valve is fully open and said inlet port is fully open, all air thereby passing through said expansion and compression means;
2) as the engine load is progressively reduced, yet while the air pressure in the engine inlet manifold remains above a first predetermined level, the inlet port is progressively, albeit partially, closed, thereby restricting the quantity of air flowing through said expansion and compression means;
3) when the engine load demand has been reduced to the point where the air pressure in the engine inlet manifold is less than the said first predetermined level, said throttle valve is progressively, albeit partially, closed and said inlet port is fixed in its partially closed position, thereby restricting the quantity of air flowing through said expansion and compression means; and
4) when the engine load has been reduced yet further to a point where the air pressure in the engine inlet manifold is less than that of the second predetermined level, the bypass valve is opened to enable air to bypass said expansion and compression means through said bypass duct.

The predetermined levels of air pressure may be varied as appropriate for different engine speeds.

According to a fourth aspect of the invention there is provided a supercharger system which includes a pressure equalisation device comprising a conduit or duct extending between the inlet and the discharge of the supercharger, with control means controlling the operation of said device.

According to a fifth aspect of the present invention there is provided a combination of an internal combustion engine and a screw supercharger to supply air into the said engine, said supercharger having a discharge duct which is connected to the engine inlet manifold and an inlet duct which draws air from outside the engine system, said supercharger being mechanically driven from the said engine, and a device for reducing the power absorbed by the supercharger when the engine is operating at a part load power demand where the supercharging effect is not required, said device comprising a pressure equalisation device which connects the discharge duct of the supercharger to the inlet duct of the supercharger, and a control means for opening or closing said pressure equalisation device selectively.

Preferably, the pressure equalisation device duct is built into the casing of the supercharger or, alternatively, the device duct is part of the engine inlet manifold.

Preferably the means of opening or closing the pressure equalisation device is a butterfly valve or a plurality of butterfly valves, and in a preferred embodiment the said control means is controlled by a sensing device which measures pressure at the inlet manifold and operates the said control means directly according to the measured pressure.

Preferably further the said control means is in turn completely or partly controlled by an electronic device which forms part of an engine management system.

Figure 2:
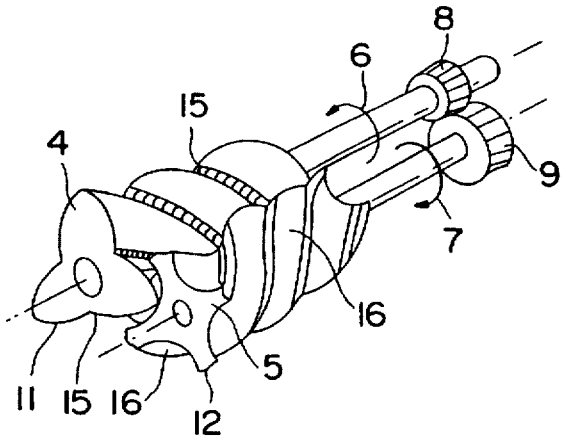
Figure 3:
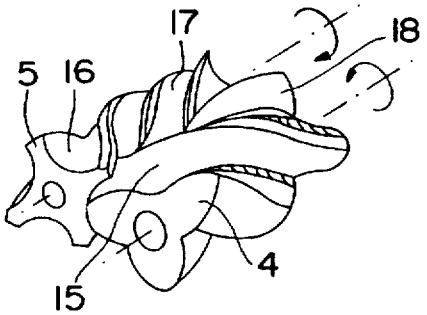
Figure 4:
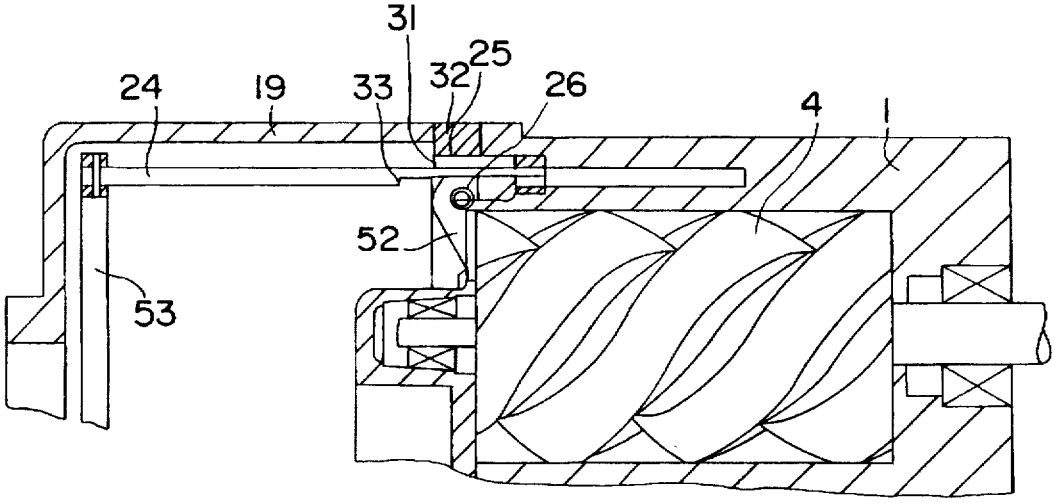
Figure 5:
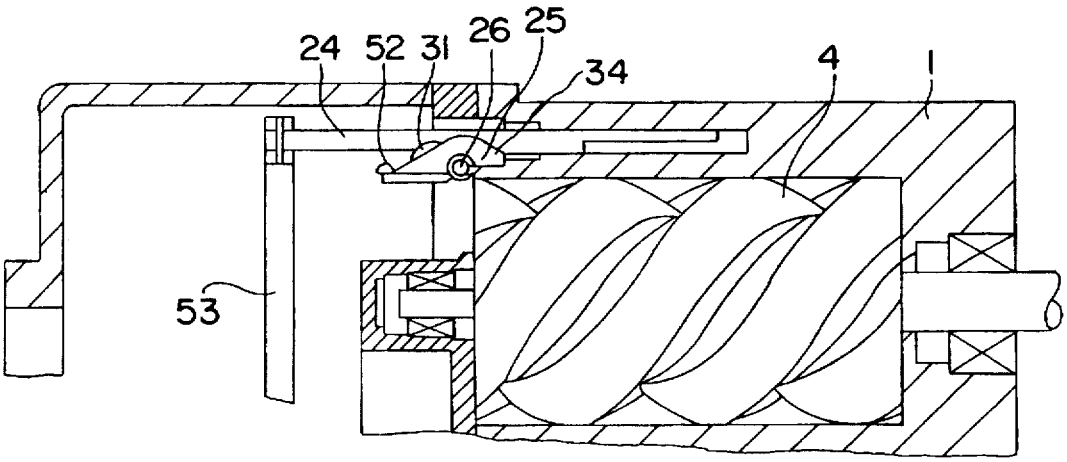
Figure 6:
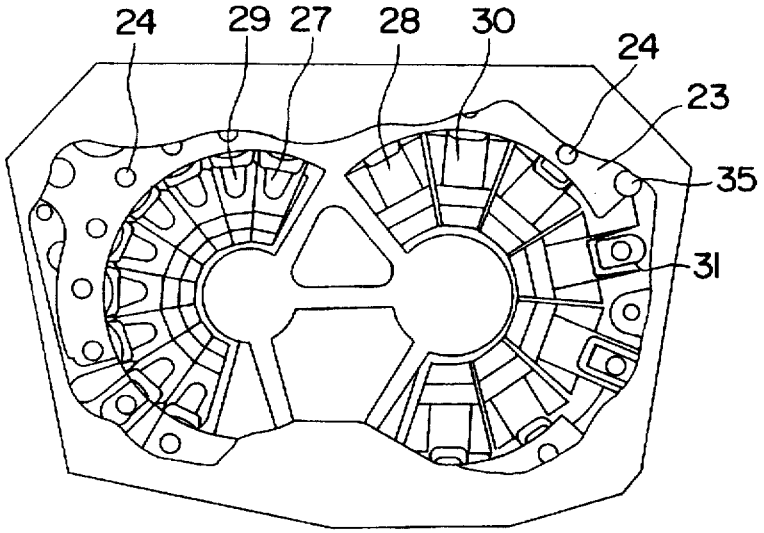
Figure 7:
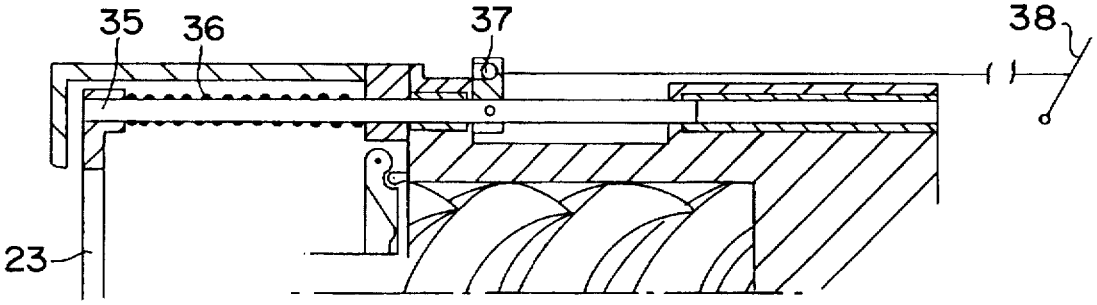
Figure 8:
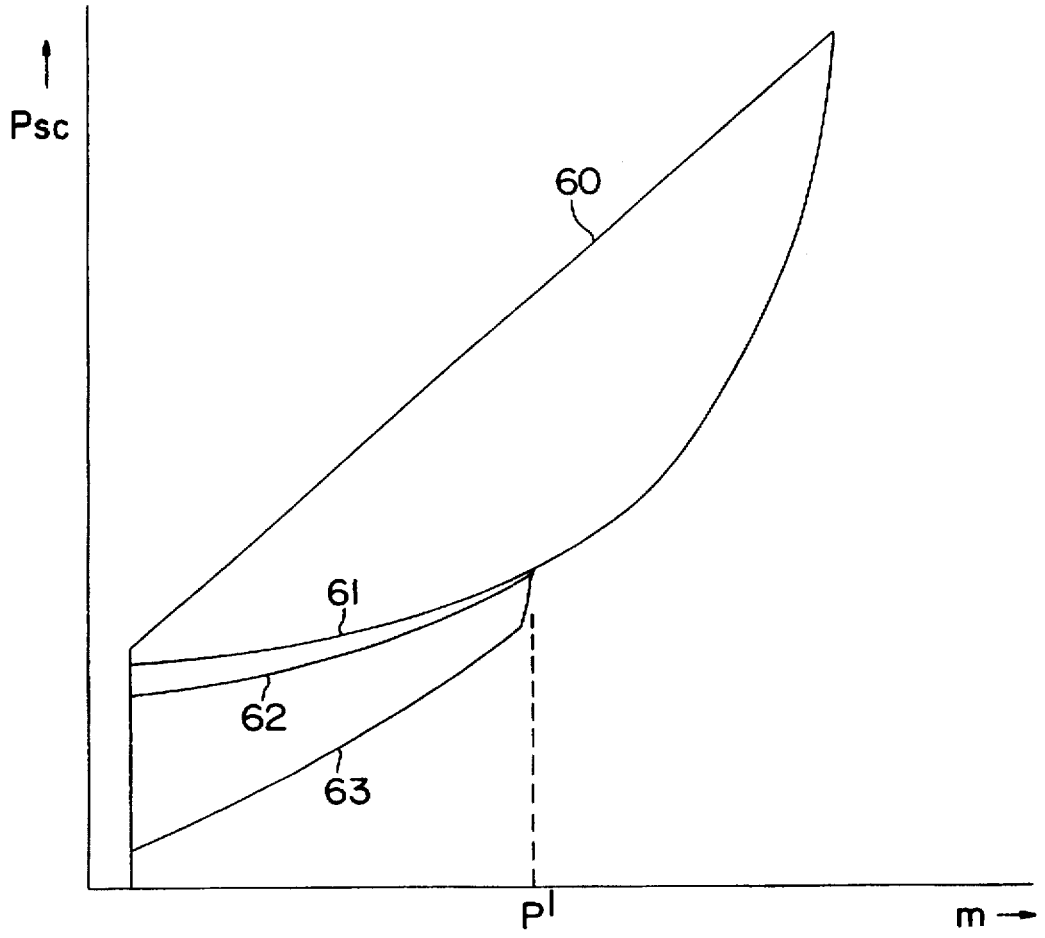
Figure 9:
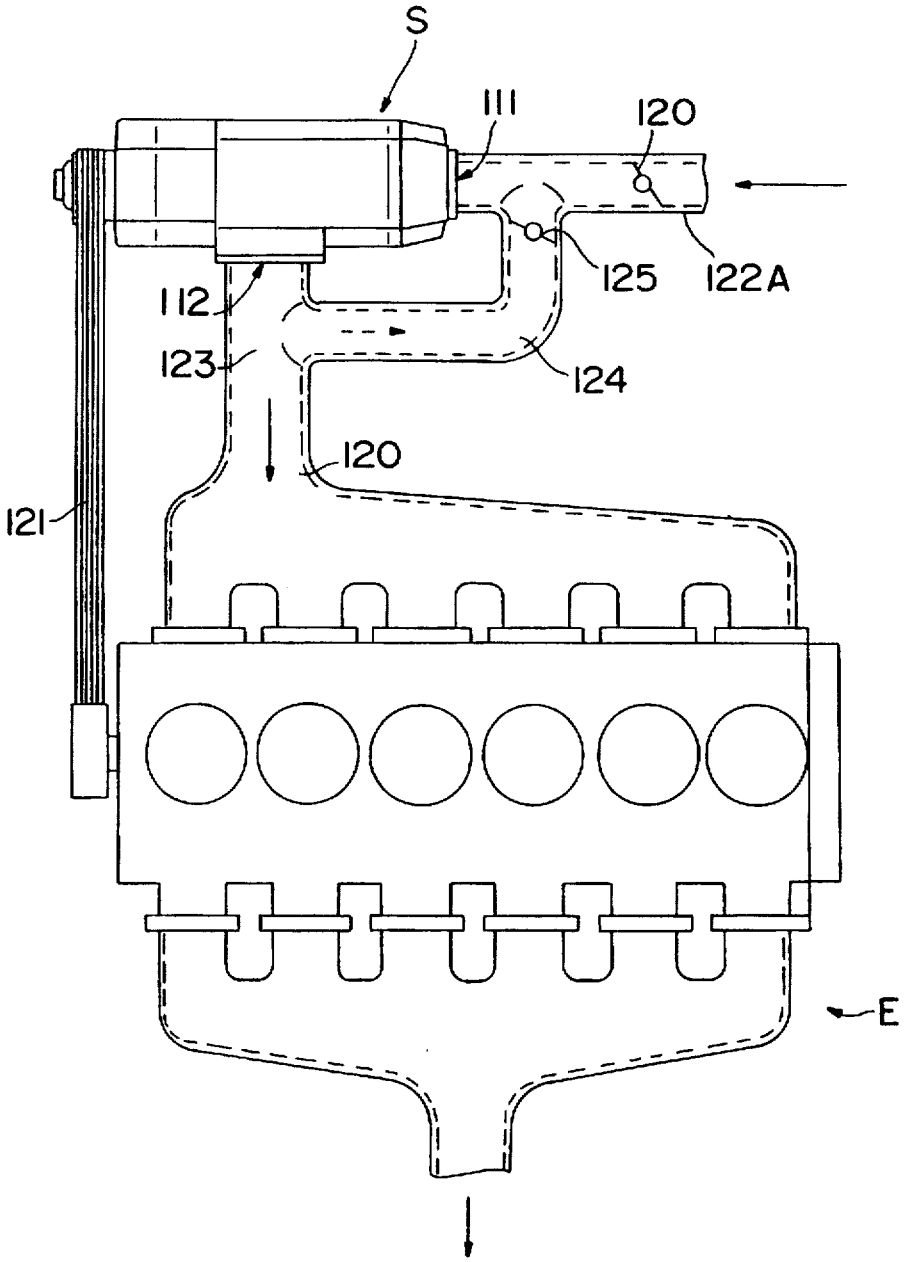
Figure 10:
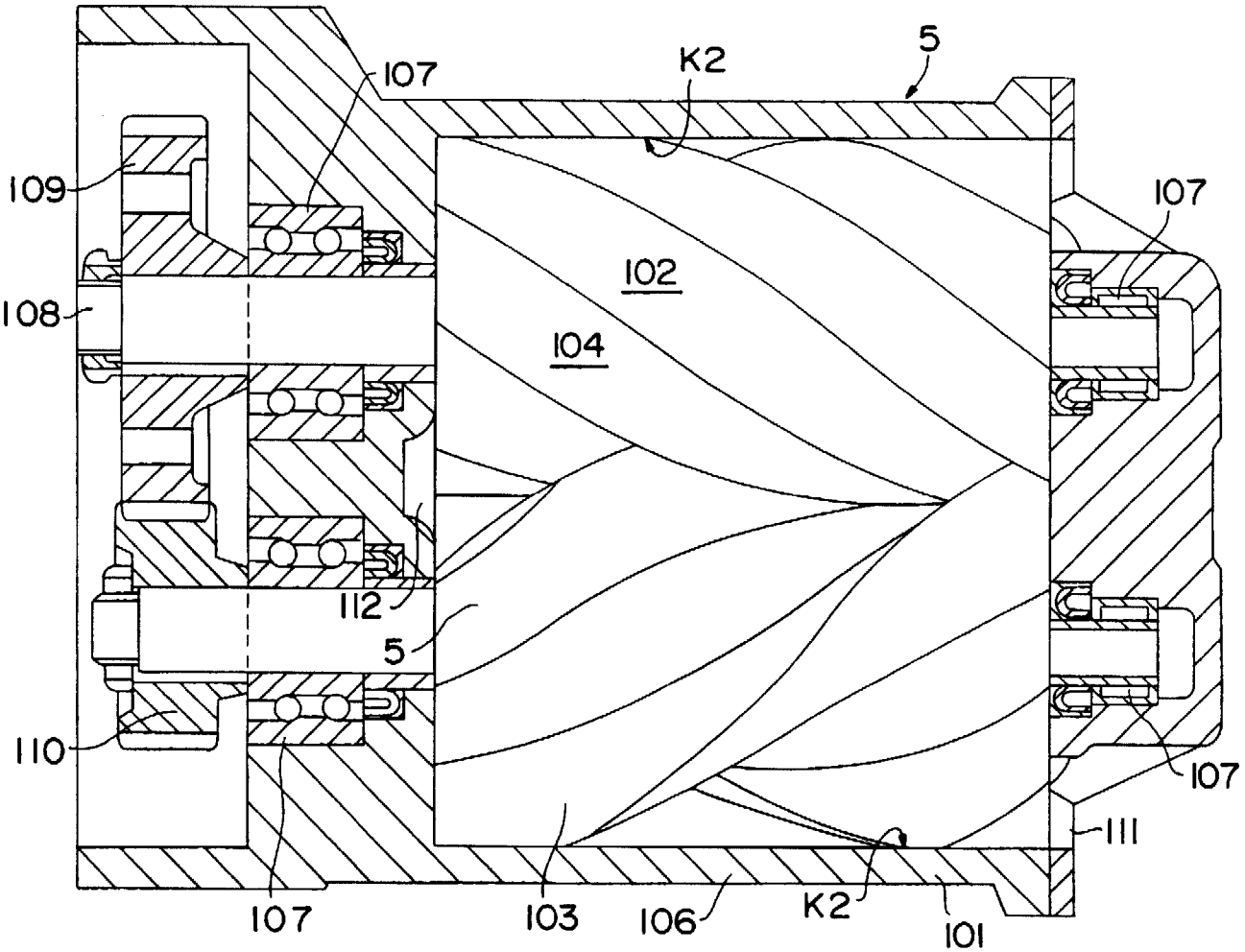
Figures 1, 11:
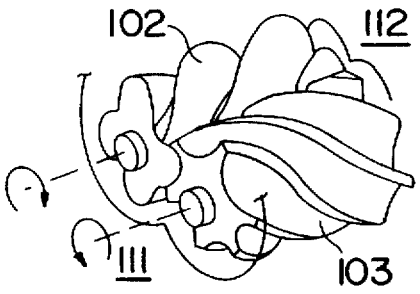
Figures 2, 11:
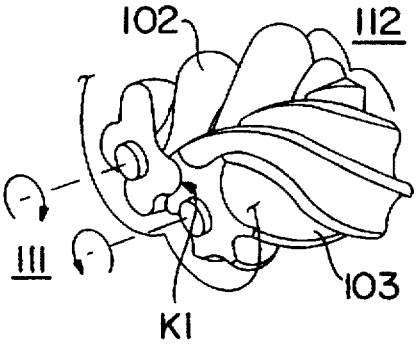
Figures 3, 11:
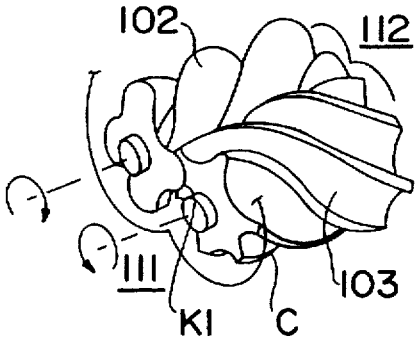
Figures 4, 11:
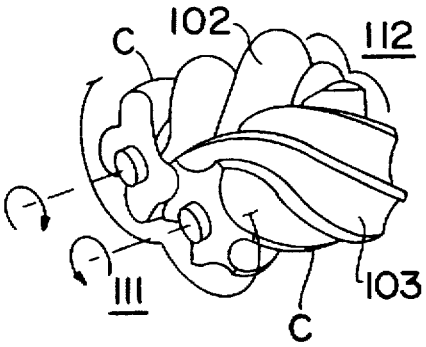
Figures 5, 11:
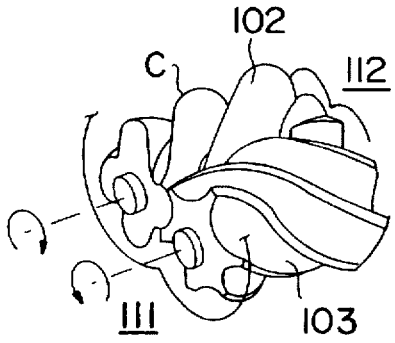
Figures 6, 11:
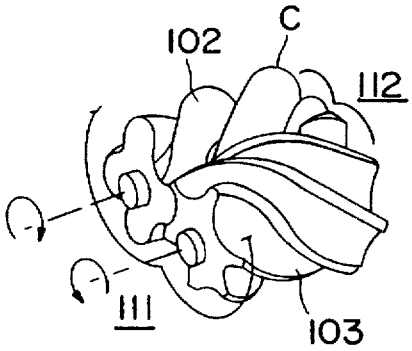
Figures 7, 11:
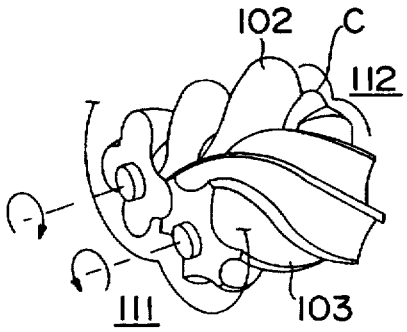

In order to more clearly demonstrate the invention, embodiments will now be described, by way of example only, with reference to the accompanying figures, in which:

FIG. 1 is a schematic diagram of a three mode control system in accordance with the present invention, FIGS. 2 and 3 show schematic views of the rotors with the rotor casing removed, FIG. 4 shows a part section through an expansion and compression means in accordance with the present invention, wherein the flap valves of said inlet control are in the closed position, FIG. 5 shows the expansion and compression means with the flap valves in the open position, FIG. 6 shows a part section of the machine as viewed from the inlet end, FIG. 7 shows a part section of the machine showing the actuator plate linkage to an accelerator cable, and FIG. 8 is a graph illustrating the relationship between supercharger absorbed power and mass flow of air into the engine, FIG. 9 shows an internal combustion engine fitted with a supercharging system in accordance with a further aspect of the present invention;

FIG. 10 shows a sectional plan view of the dry-type screw compressor used in the supercharging system of FIG. 9; and FIGS. 11/1 to 11/7 show pictorial views illustrating the operating principle of the screw compressor of FIG. 10.

Referring firstly to FIG. 1, the three mode control system comprises an expansion and compression means 19 which has an inlet 31 and an outlet 32. The expansion and compression means 19 is a screw type positive displacement machine incorporating two (male and female) intermeshing rotors housed within respective bores in a casing. The system also includes an inlet port control means 20 for controlling the intake of air into the screw type supercharger 19 through the inlet port 31.

Air is delivered to the screw compressor 19 via an air flow throttle valve 21 which is adapted to control the quantity of air being received into the system from, say, a motor vehicle air cleaner.

Furthermore, as shown in FIG. 1, the system also comprises a bypass duct 22 in which is located a bypass control valve 23. The bypass duct 22 communicates with the outlet 32, both also communicating with and supplying air to an engine 40.

FIGS. 2 and 3 show the rotors 4 and 5 contained without their casing. FIG. 2 is viewed from the inlet end and inlet side of the machine, while FIG. 3 is viewed from the inlet end of the machine. Arrows 6 and 7 show the rotation of the rotors. In FIG. 3 the voids created by grooves 17 and 18 and the casing inner surfaces are seen to be much reduced in volume compared with the voids created by grooves 15 and 16.

In FIGS. 4 to 7 there is provided a flap valve device comprising flap valves 52 in close proximity to the rotor face covering the inlet port of the machine. The flap valves 52 are actuated by means of an actuating plate 53 which is moved towards the inlet plane of the rotors by means of an external force such as accelerator pedal 38 which is connected to the actuating plate 53 through pins 35 causing the actuating plate 53 to move towards the inlet face causing actuating pins 24 which are attached to the actuating plate 53 to strike the lever arm pin 25 on the flap arm 34 on the flap valve 52 causing the flap valve to hinge around a pivot point 26 and swing up from the rotor face. Once the flap valve is in the open position the actuating pin step 33 passes the lever arm pin 25 with actuating pin 24 maintaining the flap valve in a open position. The actuation pins 24 have the steps 33 arranged to strike the lever arm pins 25 in a sequential manner allowing the inlet port to be opened at progressively later stages in the filling cycle. The female valve 27 is opened prior to the male valve portion 28. This is in turn followed by the second female valve 29 and second male valve 30. This sequence can be repeated until all the valves are vertical from the end face and the full inlet port is open achieving maximum gas displacement. The process can be reversed resulting in the closure of the valves over the inlet face.

As each valve opens a throttling loss occurs which is a function of the number of lobes in the male and female rotors. This energy cannot be recovered and is an irreversible feature of the machine.

In order to minimize the throttling losses the closing points for the male and female flap valves are at corresponding portions of the filling cycle.

As the rotors continue to rotate the trapped volume under the remaining flap valves on the rotors face continues to expand until the maximum lobe volume is achieved. The gas is then compressed. Work done during the expansion cycle therefore becomes recoverable work.

The flap valves overlie and each flap valve is spring loaded such that each flap valve returns to its closed position. The pin assembly plate is also spring loaded using spring 36 to ensure the actuation plate returns to its original position when the external actuation force through cable connection 37 from say the accelerator pedal 38 is released.

In use, the three mode control system would be operated in alternative manners depending upon the engine load. At full engine load, regardless of the specific speed, maximum air is required and thus the inlet port 31 is full open and the bypass control valve 23 in the bypass duct 22 is fully closed. Furthermore, the throttle valve 21 is also fully open to ensure that there is no unnecessary restriction on the air flow.

In this condition the pressure in the engine inlet manifold would be substantially above atmospheric pressure. However, as the engine load demand, and corresponding air demand, is progressively reduced, the inlet port control valve would be progressively closed causing the supercharger to firstly expand the air, thus recovering power, and consequently reducing the power absorbed or wasted by the supercharger screw compressor, at least relative to the power absorbed when the air flow is merely restricted by the throttle valve 21.

When the engine load demand has been reduced to the point where the air pressure in the engine inlet manifold approaches atmospheric pressure, it is preferred that the inlet port is kept at a predetermined aperture or restrictive level and the throttle valve 21 is used to reduce the air flow further. Additionally, the bypass valve 23 is opened.

Nevertheless, at this point it is alternatively possible to continue to progressively close the inlet port but it has been found in tests conducted by the inventor that the combination of restricting the inlet port, together with the partial closing of the throttle valve as disclosed above provides a more efficient method of supplying air to the engine under minimal load.

FIG. 8 is a graph showing the relationship between the power absorbed or wasted through the screw compressor (Psc) and mass flow of air (m) into the engine using the three mode control system when the engine is operating under different loads. Line 60 shows the absorbed power when the inlet throttle valve is used as the sole means of controlling air flow into the engine via the supercharger. Line 61 provides an indication of use of the inlet port control means only, while line 62 shows a combination of using the inlet port control means and the throttle valve. Finally, line 63 indicates the improved efficiency resulting from further utilizing the bypass valve with the throttle valve and the inlet port control means.

An alternative arrangement, in accordance with further aspects of the present invention will now be described with reference to FIGS. 9–11 of the drawings.

Referring to FIGS. 9–11 of the drawings, an internal combustion engine E is provided with a supercharger S for the supply of supercharged air to the engine, the supercharger S comprising a dry-type screw compressor which is connected to the inlet manifold 120 of the engine E. The supercharger S is driven from the engine E by means of a belt drive 121.

The dry type screw compressor of the supercharger shown in FIG. 10 does not use lubricating oil passing through the working zones of the machine and the rotors 102, 103 are timed by the use of timing gears 109, 110 positioned outside the working chambers of the rotors which allow the rotors to rotate without coming into contact with each other. This contrasts with wet-type screw compressors where one of the rotors (usually the male rotor) engages and drives the other rotor and to facilitate this driving operation lubricating oil in this case is passed through the rotors of the machine such a wet type screw compressor is described in U.S. Pat. No. 4,673,344.

The aforementioned dry-type rotary machines include a housing 101 having at least one pair of intersecting bores therein. Inlet 111 and outlet 112 ports are provided at opposite ends of the casing bores. A rotor 102, 103 is mounted for rotation within each of the bores.

One of these rotors 102 is of the male type which includes a plurality of helical lobes and intervening grooves 104 which lie substantially outside the pitch circle thereof with the flanks of the lobes having a generally convex profile.

The other rotor 103 is of the female type and formed so that it includes a plurality of helical lobes and intervening grooves 104 which lie substantially inside the pitch circle thereof with the flanks of the grooves having a generally concave profile.

The lobes on the male rotor co-operate with the grooves on the female rotor and the walls of the casing to define chambers for the fluid. These chambers may be considered to be chevron shaped.

The screw compressors have internal volume reduction resulting in internal compression of the air. As the rotors 102, 103 rotate, chambers C are formed between the male and female rotors in the area connected to the inlet port 111 (see FIGS. 11/1–11/7). Each chamber increases in size, drawing air into the machine. The chamber C then reaches a maximum volume (FIGS. 11/5) and the inlet port 111 is closed. Further rotation causes the chamber C to reduce in volume (FIGS. 11/6, 11/7) until the rotors 102, 103 come completely into mesh and the chamber disappears. As the chamber reduces in volume the air within it is compressed following an isentropic process. The outlet port 112 is positioned on the casing 106 at the point where the chamber reaches the desired pressure and the gas flows into a discharge duct 123A.

As described above, there is a disadvantage with mechanically driven positive displacement superchargers at low engine power requirements because the supercharger is still working and is still absorbing power from the engine.

To meet this problem, the present system utilises a pressure equalisation means comprising a duct 124 connecting the supercharger inlet 111 to the supercharger discharge 112, and the operation of the duct 124 is controlled by a control valve 125 (additional to the normal air massflow control valve/throttle 126 in the inlet duct 122A). A suitable actuating system (not shown) will be provided for setting of the valve 125 appropriately at selected engine load conditions. The valve 125 can comprise a butterfly valve and it would be possible for a plurality of valves to be present. The reason why the supercharger can work satisfactorily with such an arrangement will now be explained.

Therefore, attention is drawn to the fact that the dry screw machine does not operate exactly as a positive displacement compressor. A clearance $K_1$ is required between the two rotors 102, 103 while a clearance $K_2$ is present between the rotors 102, 103 and the case 106. These act as leakage paths and have an effect on the compression process within the machine. The magnitude of this effect depends on the compressor speed and the pressures between the different chambers C and between the chambers C and the discharge port 112. When the screw machine operates as a compressor, this leakage is backwards from the discharge port 112 to the chambers C adjacent to the port 112 and through subsequent chambers to the inlet port 111. This leakage gas is recompressed and this increases the absorbed power and the discharge temperature. If the duct 124 is opened between the discharge port 112 and the inlet port 111, the pressure in the discharge port falls to that of the inlet 111. The leakage direction now changes. The internal compression still occurs and some of the leakage is still back towards the inlet port 111. However, due to the low pressure in the discharge port 112, a significant portion of the leakage is now forwards into the discharge port 112. This "forward leakage" reduces the maximum internal compression pressure thus reducing the absorbed power and the discharge temperature. There is also less force required to expel the compressed gases into the discharge port 112. These effects are much greater at lower speed where the gas has more time to leak from one chamber C to the other. A significant reduction in supercharger absorbed power is achieved at low engine power and at low to medium engine speeds due to the reduction in compression in the supercharger. The combined effects of the reduction in internal compression and the expansion of the gases into the low pressure at the discharge port 112 serve to reduce the discharge temperature.

The actuating system for the valve 125 can include a device which measures the pressure at the inlet manifold 120 and effects opening or controlling of the duct 124 directly according to the measured pressure. The means of controlling operation of the duct 124 may be completely or partly controlled by an electronic device, for example forming part of a management system for the engine E.

While the pressure equalisation duct 124 is shown as comprising a separate pipe in FIG. 9, it would be possible to have this duct 124 built onto other machine parts, especially into the supercharger S or into the inlet manifold 120.

The present invention provides a means to reduce the power absorbed by a screw supercharger in the part load engine operating conditions where the supercharging effect is not required. The device is simple, effective, and may easily be implemented on current screw supercharger designs.

A suitable supercharger S for the system is that "SPRINTEX" (RTM) supercharger of the present applicant.

We claim:

1. A three-mode control system for controlling the flow of inlet air into a supercharged spark ignition engine comprising:

an air expansion and compression means;

an inlet manifold;

an inlet port control means for controlling the intake of air into the expansion and compression means, said inlet port control means including an inlet port valve which is open at fill engine load and progressively closes when the engine load is progressively reduced while the inlet manifold pressure remains above a predetermined level;

an air flow throttle valve located upstream of said expansion and compression means which is open at full engine load and progressively closes when the engine load is progressively reduced and the inlet manifold pressure falls below said predetermined level; and a bypass duct which can optionally bypass air around the expansion and compression means which is closed at full engine load and progressively opens when the engine load is reduced and the inlet manifold pressure falls below said predetermined level;

wherein:

the air supply to said engine may be throttled by said throttle valve before passing to the engine via said expansion and compression means or said bypass duct.

2. A three mode control system according to claim 1 wherein said control system is controlled by the operation of said throttle valve, said port control means, and said bypass valve.

3. A control system as claimed in claim 1 wherein the bypass duct includes a bypass valve for controlling optional flow of air through said bypass duct.

* * * * *

UNITED STATES PATENT AND TRADE MARK OFFICE

CERTIFICATE OF CORRECTION

PATENT NO. : 5,791,315
DATED : August 11, 1998
INVENTOR(S) : Riach et al.

It is certified that error appears in the above-identified patent and that said Letters Patent is hereby corrected as shown below:

Column 8, line 18, should read:

is open at full engine load and progressively closes

Signed and Sealed this

Eighth Day of December, 1998

Bruce Lehman

*Attest:*

BRUCE LEHMAN

*Attesting Officer*

*Commissioner of Patents and Trademarks*